US009278731B1

(12) United States Patent
Canela

(10) Patent No.: US 9,278,731 B1
(45) Date of Patent: Mar. 8, 2016

(54) INFLATABLE BOAT TRANSOM PLATFORM DEVICE

(71) Applicant: Ramon Canela, Fort Lauderdale, FL (US)

(72) Inventor: Ramon Canela, Fort Lauderdale, FL (US)

( * ) Notice: Subject to any disclaimer, the term of this patent is extended or adjusted under 35 U.S.C. 154(b) by 0 days.

(21) Appl. No.: 14/624,717

(22) Filed: Feb. 18, 2015

(51) Int. Cl.

| | |
|---|---|
| ***B63B 7/08*** | (2006.01) |
| ***B63B 17/00*** | (2006.01) |
| ***B63B 5/24*** | (2006.01) |
| ***B63B 25/00*** | (2006.01) |
| ***B63B 25/20*** | (2006.01) |
| ***B63B 43/18*** | (2006.01) |
| *B63B 7/00* | (2006.01) |

(52) U.S. Cl.
CPC ... *B63B 7/08* (2013.01); *B63B 5/24* (2013.01); *B63B 17/00* (2013.01); *B63B 25/006* (2013.01); *B63B 25/20* (2013.01); *B63B 43/18* (2013.01); *B63B 2007/006* (2013.01)

(58) Field of Classification Search
CPC ..... B63B 1/20; B63B 17/00; B63B 27/00; B63B 27/14
USPC ..... 114/343, 362, 364
See application file for complete search history.

(56) References Cited

U.S. PATENT DOCUMENTS

| | | | | |
|---|---|---|---|---|
| 4,372,243 | A * | 2/1983 | Roope, Jr. | B63B 17/00 114/343 |
| 4,669,414 | A * | 6/1987 | Molino | B63B 27/14 114/343 |
| 5,632,224 | A * | 5/1997 | Schneider | B63B 27/143 114/362 |
| D742,804 | S * | 11/2015 | Kim | D12/317 |
| 2001/0027740 | A1 * | 10/2001 | Arias | B63B 27/14 114/362 |

* cited by examiner

*Primary Examiner* — Lars A Olson

(57) ABSTRACT

An inflatable boat platform floatation device having a "T" or "U" shaped opening in the front surface that receives the motor(s) and wraps around the motor(s) and sides of a boat allowing the front surface to engage the transom and side surfaces forming the opening at the front surface to engage the sides of the boat near the stern such that the platform rests against the boat in a manner that shields the propeller(s) from ropes, debris, hands and feet while providing a platform for the passengers outside the boat. The platform has top and bottom surfaces that are connected by stitched polyester fibers ("SPF") which hold the surfaces together and determine the platform's thickness when inflated and keep the surfaces uniform and rigid when the platform is inflated. The upper surface includes at least one ethylene vinyl acetate (EVA) pad. The platform further includes a plurality of handles, at least one inflation and deflation valve and a plurality of D-rings for securing the platform to a boat and tethering other platforms or tethering other watercraft to the platform.

20 Claims, 5 Drawing Sheets

INFLATABLE BOAT TRANSOM PLATFORM DEVICE

CROSS-REFERENCE TO RELATED APPLICATION n/a

STATEMENT REGARDING FEDERALLY SPONSORED RESEARCH OR DEVELOPMENT

N/A

FIELD OF THE INVENTION

The present invention relates to an inflatable boat platform, and in particular, to an inflatable boat transom platform device that has a "T" or "U" shaped opening to allow the platform to rest against the transom and sides of the boat while enveloping the boat motors to provide a shield that keeps ropes and debris away from the propeller as well as hands and feet. Additional platforms may also be tethered to the transom platform. The instant invention is also reinforced internally with stitched polyester fibers.

BACKGROUND OF THE INVENTION

The Problem.

Various platform devices for boats are known in the background art. For instance, U.S. Pat. Nos. 8,702,461, 7,867,049 and 7,837,526 issued to d'Offay (the "d'Offay patents") disclose a floatable workstation including an inflatable base assembly having optional partitions disposed internally within an receiving cavity of a tube to form one or more inflatable chambers, each chamber including a valve for inflating the chambers. A deck attachment/assembly consisting of a plurality of deck boards are connected together to form a work surface/floorboard and are positioned on the upper surface of the inflatable base assembly. A deck attachment textured surface is provided upon the assembly for removably securing the series of deck boards.

U.S. Pat. No. 7,302,902 ("the '902 patent") issued to Stillman discloses an inflatable mooring station for use with a fixed or floating platform extending over a body of water. The mooring station is attached to the platform. The mooring station includes a buoyant, inflatable body and at least one line tie. The mooring station forms two three-sided docking areas for receiving watercraft.

U.S. Pat. No. 6,805,066 ("the '066 patent") issued to Johnson discloses a floating platform that has a flat low profile for use by swimmers, divers, boaters, and those engaged in other activities on water. The platform is used alone or as a module in combination with other such floating platform modules; attaching the modules to form a larger floating platform.

U.S. Pat. No. 6,475,048 ("the '048 patent) issued to Gredy discloses an inflatable raft tethering arrangement that includes an inflatable raft and a tether. The inflatable raft has an aperture and a rigid reinforcement. The tether includes a clasp, a cord, and a suction mechanism. The clasp is secured to the raft through the aperture and the cord secured to the clasp and the suction mechanism. The suction mechanism is attached to a surface to keep the raft in a particular area.

U.S. Publication No. 2006/0003646 ("the '646 Publication") a towable structure configured to be towed behind a boat while floating above the surface of a body of water.

It appears that no single prior art reference uncovered in the search clearly sets forth all of the elements of the invention. No reference we found discloses an inflatable and floatable boat platform having a "T" shaped opening or cutout that receives the motor(s) and wraps around the sides of the boat allowing the front surface of the platform to engage the transom while shielding the motor from ropes, debris, hands and feet. The references also do not disclose the use of stitch polyester fibers (SPF) to connect the top and bottom surfaces together so as to hold the surfaces together and keep the surfaces uniform and rigid as the platform is inflated. Moreover, the references to not disclose a platform having a top surface that comprises EVA foam.

While the d'Offay references disclose a floatable workstation including an inflatable base assembly that can be tethered to a boat. The d'Offay references to not disclose or suggest a "T" or "U" shaped opening for receiving an outboard motor (s) so as to allow the front surface of the platform assembly to engage the transom of the boat. In fact, the d'Offay references do not even contemplate the desire for an inflatable platform that can fully engage a boat transom. Rather, the d'Offay patents disclose an inflatable workstation design for being tethered to the boat for washing, waxing, buffing or making repairs to the outer surface of the boat to maintain both the function and appearance of the vessel.

Likewise, none of the other references disclose a "T" or "U" shaped opening or opening that could be combined with d'Offay. The '066 patent merely discloses a floating platform. The '902 patent discloses an inflatable mooring station that provides two "U" shaped openings for holding personal watercraft, such as jet skis. The mooring station disclosed in the '902 patent is not designed for receiving an outboard motor to engage a transom, nor does the reference contemplate or suggest such a use, even if possible. The '048 patent discloses an inflatable raft, tether and suction cup assembly for attachment to a surface to keep the raft in a particular area and does not disclose or suggest a design for having the raft engage the transom of a boat. Lastly, the '646 Publication discloses an inflatable towable float designed to be towed behind a boat, which teaches away from and clearly does not suggest engagement with a boat transom.

The foregoing patents fail to disclose an inflatable boat transom platform device that rests against the transom and sides of a boat while enveloping the motor as realized by the instant invention. It is therefore desirable to have such an inflatable boat transom platform that protects the propeller from debris, ropes, hands and feet while providing a comfortable platform for relaxing behind a boat. If there existed such a device it would address the shortcomings in the background art and provide a convenient device for enabling an enjoyable and safe boating, swimming and fishing experience behind a boat. As there are no known devices that provide an inexpensive albeit practical inflatable boat transom platforms, there exists a need for such a device. It is, therefore, to the effective resolution of the aforementioned problems and shortcomings of the prior art that the present invention is directed. The instant invention addresses this unfulfilled need in the prior art by providing an inflatable boat transom platform device as contemplated by the instant invention disclosed.

SUMMARY OF THE INVENTION

In light of the foregoing, it is an object of the present invention to provide an inflatable boat transom platform device that wraps around an outboard motor while fully engaging the transom of a boat.

It is also an object of the instant invention to provide an inflatable boat transom platform device that wraps around an outboard motor while fully engaging the sides of a boat It is another object of the instant invention to provide an inflatable boat transom platform device that is reinforced with internal stitch polyester fibers.

It is an additional object of the instant invention to provide an inflatable boat transom platform that protects ropes, hands and feet from getting caught in the propeller(s).

It is a further object of the instant invention to provide an inflatable boat transom platform that uses ethylene vinyl acetate for soft, safe and strong material to rest on.

It is yet another object of the instant invention to provide an inflatable boat transom platform that incorporates valves for convenient inflating.

It is yet a further object of the instant invention to provide an inflatable boat transom platform having handles and side rail fabric.

It is yet an additional object of the instant invention to provide an inflatable boat transom platform that can have other platforms tethered to it.

It is still another object of the instant invention to provide an inflatable boat transom platform that provides a private, fun and safe self-sustaining floating island attachable to a boat that also offers an offshore private beach that is expandable with others having a complimentary inflatable platform in accordance with the instant invention.

It is still an additional object of the instant invention to provide an inflatable boat platform that is secure and provides for boat area expansion with extended space when inflated and that easily fits in a storage area of a boat when deflated and not in use.

It is still a further object of the instant invention to provide an inflatable boat platform that provides an expanded dock off the transom of a boat that also provides a docking station for jet skis and smaller boats that insulates the host boat from impact from adjoining jet skis, boats, platforms and other watercraft.

It is yet another object of the instant invention to provide an inflatable boat platform having at least one inflation valve designed for a quick pressure system that can virtually instantaneously inflate boat platform in the event of an emergency to provide a life sustaining floating barge.

In accordance with one aspect, the present invention provides an inflatable boat platform floatation device (the "platform" or "invention") designed to fit around one or more outboard motors while engaging the transom and sides of the boat. The platform comprises a front surface having a "T" or "U" shaped opening or cutout that receives the motor(s) and wraps around the sides of the boat allowing the front surface to engage the transom. Side surfaces extend from the front surface to a back surface to essentially form a rectangular design. The "T" or "U" shaped opening shields the propeller (s) from ropes, debris, hands and feet. The opening is preferably T-shaped to wrap around the sides of the boat while engaging the transom.

In another aspect, the present invention provides an inflatable boat platform designed to fit around one or more outboard motors while engaging the transom and sides of the boat and has a strong, safe and comfortable top surface and bottom surface. The top and bottom surfaces are connected by stitched polyester fibers ("SPF") which hold the surfaces together and keep the surfaces uniform and rigid as the platform is inflated. The length of the fibers dictate the thickness of the platform once inflated. The platform is inflated through a valve preferably located in the top surface. The top surface includes EVA foam that has flexible and soft properties.

In another aspect, the present invention provides an inflatable boat platform designed to fit around one or more outboard motors while engaging the transom and sides of the boat and that can also have other platforms tethered to it. The platform further includes a pair valves located near the front surface for convenient inflation and a pair of D-rings on the front surface inside the T-opening and a D-ring on each corner of the back surface that allows for tethering other platforms, securing other water craft such as jet skis or for providing support while maneuvering around the platform.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
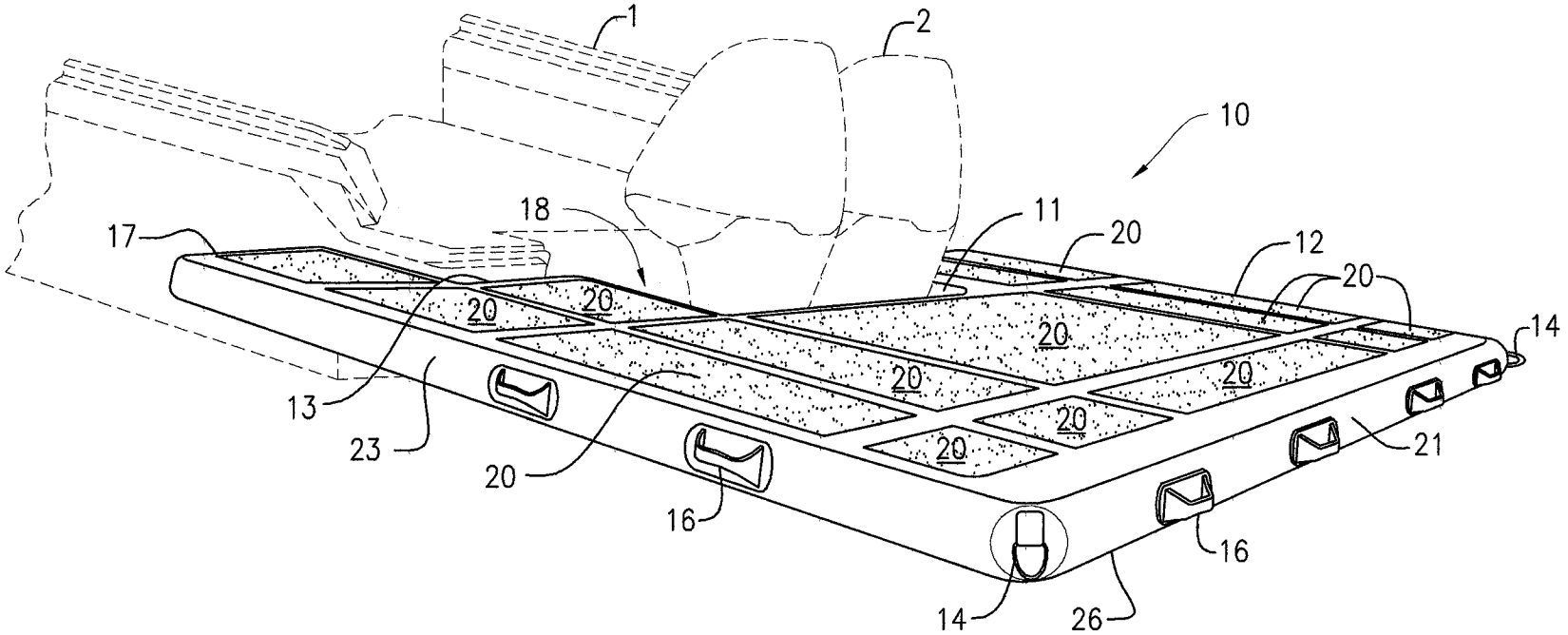
FIG. 1 is a top perspective view of the inflatable boat transom platform device attached to a boat in accordance with the principles of the present invention.
Figure 2:
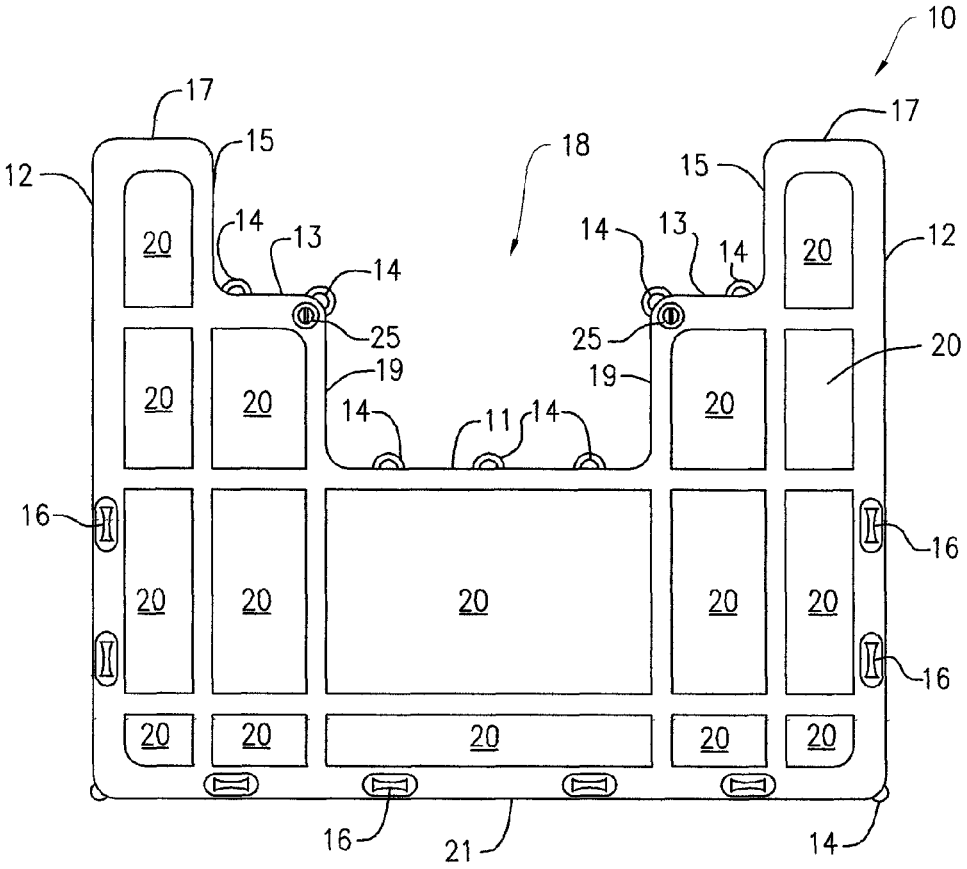
FIG. 2 is a top elevational view of the inflatable boat transom platform device shown in FIG. 1.

With reference to the drawings in which like reference designators refer to like elements, FIGS. 1 to 5 depict the preferred and alternative embodiments of the instant invention which is generally referenced as an inflatable boat platform, platform and, or by numeric character 10. Referring to FIGS. 1-2, the inflatable boat platform device is designed to fit around one or more outboard motors 2 while engaging the transom and sides of the boat 1. The platform 10 has a front end with a "T" or "U" shaped opening 18 that receives the motor(s) 2 and wraps around the sides of the boat 1. The opening 18 is preferably T-shaped to wrap around the sides of the boat 1 and the motor(s) 2 in a manner that allows the platform 10 to engage simultaneously to the transom and sides of the section of a boat. The opening 18 preferably has two tiers; an upper tier and lower tier wherein the upper tier is wider than the lower tier. The upper tier is defined by a first or port side projection and second or starboard projection. The port and starboard projections include inside front surfaces 13, inside side surfaces 15 and outside front surfaces/walls 17. The inside front surfaces 13 face forward towards the transom and the inside side surfaces 15 provide opposing walls that face each other and engage the side of the boat 1. The lower tier separates the inside front surfaces/walls 13 of the upper tier. The lower tier is defined by a lower inside front surface 11 that faces forward towards the motor(s) 2 and opposing lower inside surfaces 19 that face each other. The lower inside front surface 11 separates the lower inside surfaces 19. With reference to FIG. 1, when the platform 10 is attached to a boat 1, the inside front surfaces 13 and inside side surfaces 15 of the upper tier engage the sides of the boat 1 and the transom of the boat, respectively, and the lower tier's lower inside surface 11 and lower inside surfaces 19 wrap around the motor(s) 2 in a manner that provides little to no gap between the platform 10 and motor(s) 2. The width of the lower tier may be smaller to accommodate one motor 2 or wider to accommodate two or more motors. The design, shape and size of the opening 18 facilitates the platform 10 in shielding the propeller(s) from ropes, debris, hands and feet.

Still referring to FIGS. 1 and 2, the inflatable boat platform 10 of the instant invention has an upper surface 12 and lower surface 26. The upper surface 12 and lower surface 26 preferably comprise individual panels. A rear wall 21, sidewalls 23 on each side of the platform 10, the outside front surfaces/walls 17 and inside walls 15, 19 are disposed between and connected to the upper surface 12 and lower surface 26. The rear wall 21, sidewalls 23, front walls 17 and inside walls 15, 19 preferably comprise a fabric approximately 0.7 mm thick, but the thickness may vary. The rear wall, 21, sidewalls 23, front walls 17 and inside walls 15, 19 may be integrally formed with the upper and lower surfaces 12 and 26, respectively, to provide a seamless transition and construction for enhanced structural waterproofing to prevent leaks. In the preferred embodiment of the instant invention 10, the top surface 12 includes at least one and preferably a plurality of ethylene vinyl acetate (EVA) foam pads 20, or comparable expanded rubber or foam rubber, to provide a safe, comfortable and flexible surface. EVA typically includes vinyl acetate, polyethylene, low polyethylene, AC, foaming agents and similar vinyl acetates. EVA is a preferred material for the pads 20 because of its buoyancy, light weight, ease to form and odorless properties. It is also cost effective and less expensive compared to natural rubber. In the preferred embodiment, the inflatable boat platform 10 includes a plurality of handles 16 secured to the platform 10. The handles 19 may be secured to the sidewalls 23 and rear wall 21, as shown in FIG. 1, or to the upper surface 12, as shown in FIG. 2. The handles 19 preferably comprise PVC and a plug design that makes an airtight seal with the platform 10. Alternatively, the handles 16 may be adhered to the platform 10 with a strong adhesive. The inflatable boat platform 10 also has at least one air pressure valve 25 plugged into the upper surface 12 in a manner that makes an airtight seal, as shown in FIG. 2. Alternatively, the valve(s) 25 may be installed in a sidewall 23, the rear wall 21, in one or more of the front wall surface 17 or in one of the inside walls 15 or 19 that make up the upper and, or lower tiers. The valve(s) 25 are preferably Halkey-Roberts® valves designed for use with inflatable products and provide quick and easy inflation. In an alternative embodiment, the platform 10 may comprise multiple chambers and a valve 25 for each chamber. The valve(s) 25 provides a quick pressure system that can instantly inflate the platform in the event of an emergency.

Figure 3:
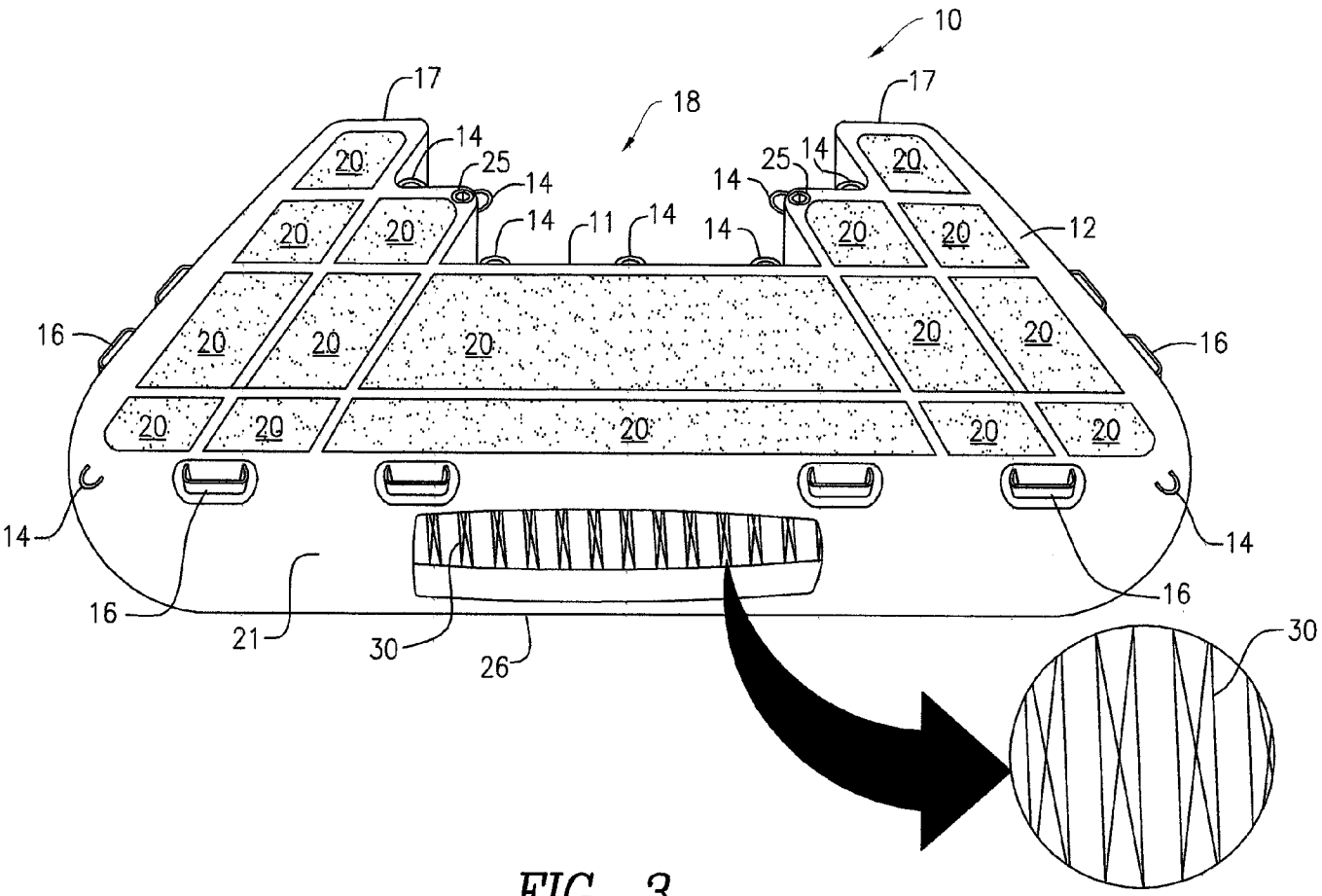
FIG. 3 is a front perspective view of the inflatable boat transom platform device of FIG. 1 with a partial cutaway showing the polyester space yarn.
Figure 4:
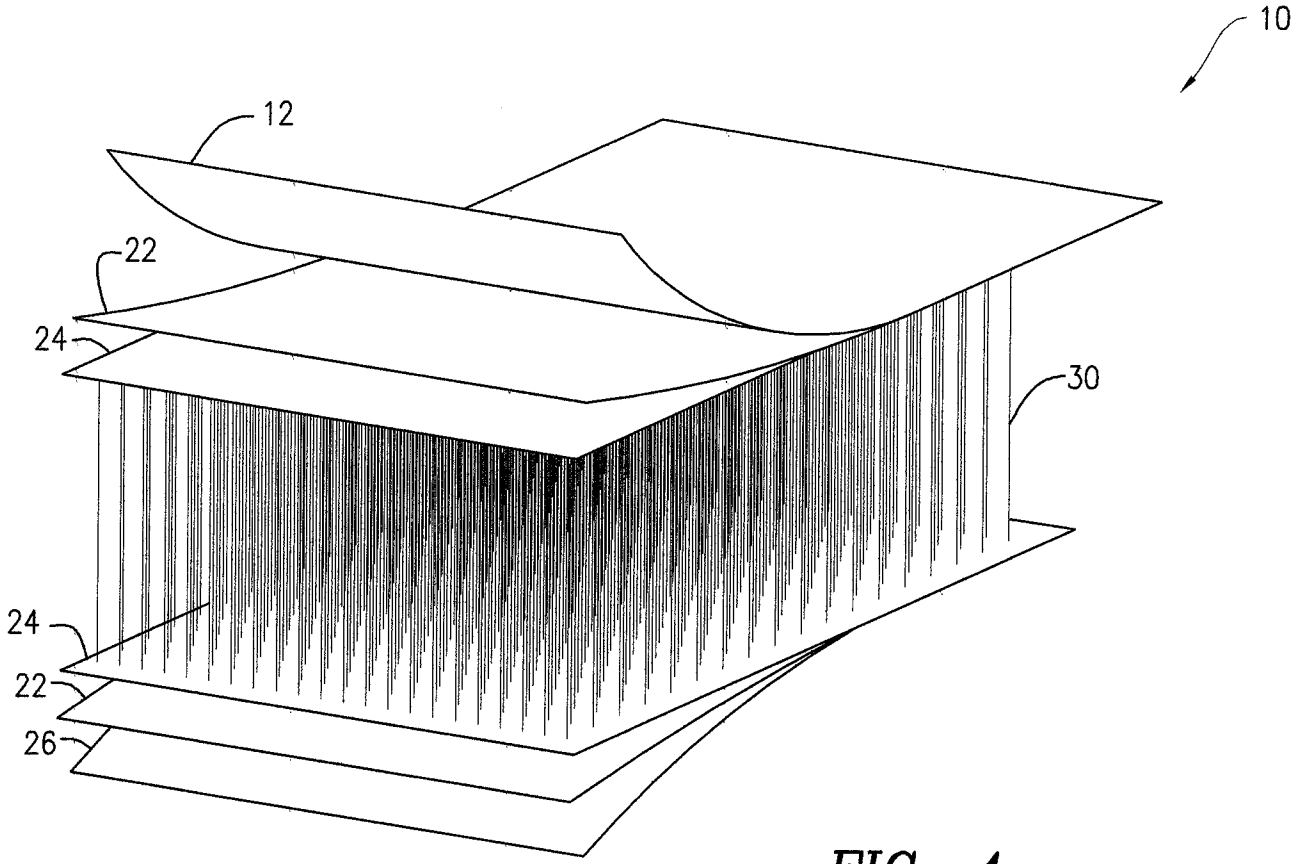
FIG. 4 is a partially exploded perspective view of the materials and layers of the inflatable boat transom platform device of FIG. 1.

Referring to FIGS. 3 and 4, the upper surface 12 and lower surface 26 are held together by a plurality of stitch polyester fibers (SPF) 30 when the platform 10 is being inflated and is inflated. The fibers 30 do not bend, lean or twist and keep the surfaces 12, 26 uniform and rigid during inflation and when inflated. The fibers 30 provide a polyester space yarn wherein the length of the fibers 30 determine the thickness of the platform 10. With reference to FIG. 4, the platform 10 is made from a drop stitch fabric and includes a plurality of layers. The upper surface 12 and lower surface 26 provide the outside surface layers which are made from a liquid PVC coating with a matt finish and include a second upper inside PVC coating layer 22 inside the upper surface 22 and a second upper inside PVC coating layer 22 inside the lower surface 26. The outside surface layers 12, 26 and upper and lower second inside layers 22 may vary in thickness, such as 70 mm, 100 mm, 150 mm, 200 mm and 400 mm. A base cloth 24 is disposed between the upper and lower second inside layers 22 and the fibers 30 wherein the fibers 30 are secured to the base cloth 24 at each end, as shown in FIG. 4. The upper and lower outside surface layers 12 and 26, upper and lower second inside layers 22 and upper and lower base cloth layers 24 are secured together such as by adhesion, with adhesives, or other materials or methods known in the art.

Figure 5:
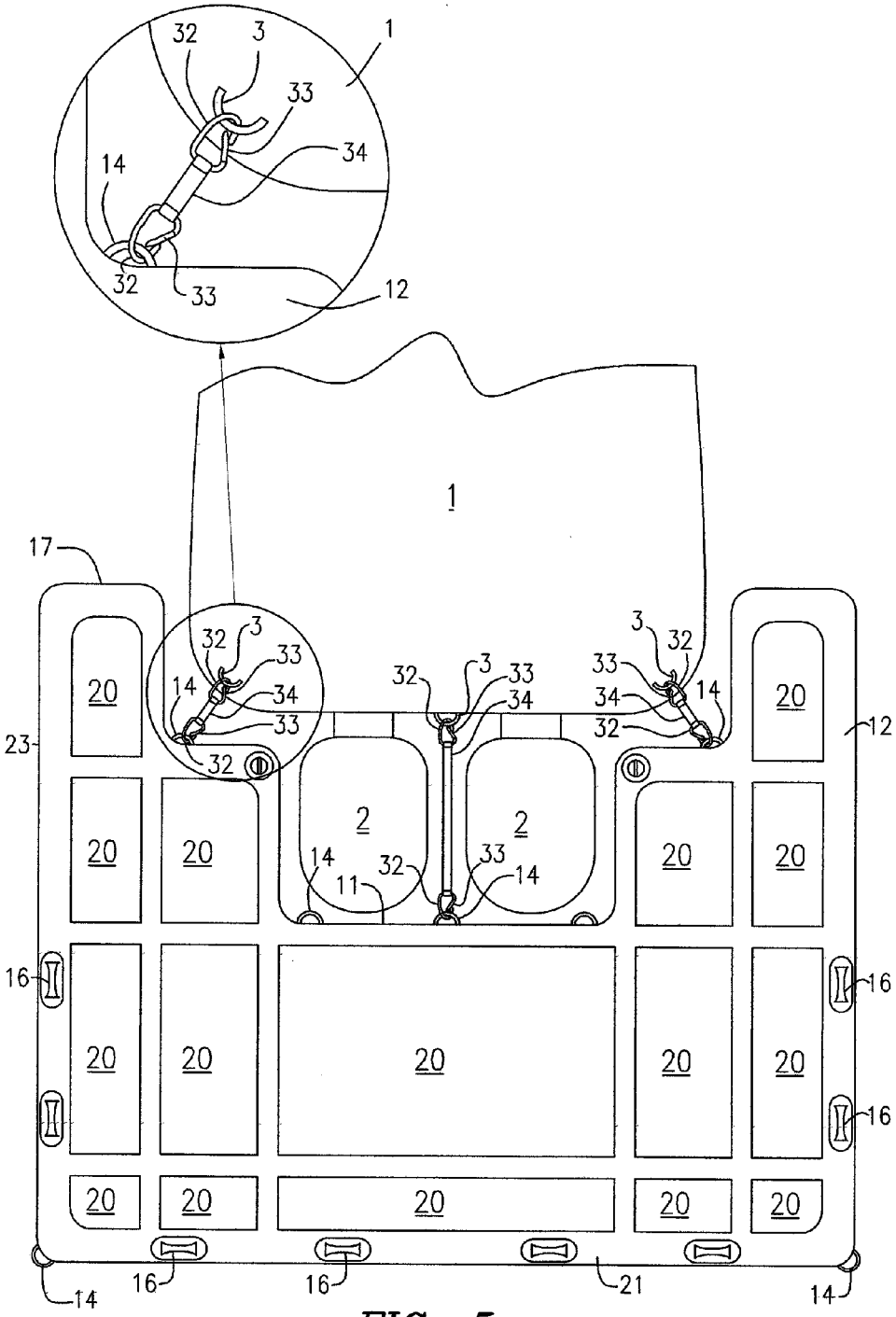
FIG. 5 is a top elevational view of the inflatable boat transom platform device of FIG. 1 illustrating the connection to a boat.

Now referring to FIG. 5, the inflatable boat platform 10 may be attached to virtually any boat but is especially designed for boats with outboard motors. The platform 10 preferably has a T-shaped opening that wraps around the rear sides of a boat 1 and its motor(s) 2. The platform 10 is secured to a boat preferably using clamps or clips 32 and straps 34. The clips 32 preferably comprise C-clips or clamps with a spring loaded arm 33 that snaps over the hook 3 of a boat 1 with a clip 32 on each end of the strap 34. The straps 34 are preferably adjustable for pulling the platform 10 close to the transom. The platform 10 is preferably secured with a strap 34 and clip 32 assembly on or near each corner of the stern or transom, depending on the location of the boat hooks 3. The clips 32 are clipped to the hooks 3 on or near the corner of the transom or stern at one end and to the corresponding D-rings 14 on the platform 10 at the other end. Another strap 34 and clip 32 assembly is preferably connected to a hook 3 in the middle of the transom at one end and to a corresponding D-ring 14 on platform 10 at the other end. The straps 34 are then adjusted to draw the platform 10 up against and around the transom and around the motor(s) 2. Alternatively, bungee cord or elastic rubber straps with hooks or clips 32 at each end may be used.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An inflatable boat transom device that is releasably attachable to a boat having at least one outboard motor, comprising:

a body having an upper surface, a bottom surface, a bifurcated front surface, a rear surface and first and second side surfaces separated by said front surface and said rear surface and joining said front surface to said rear surface and said upper surface to said lower surface so as to define an interior volume;

an opening formed in said bifurcated front surface and extending into said body for receiving at least one outboard motor;

a plurality of fibers connecting said upper surface to said bottom surface, said fibers determining the thickness of said body when inflated;

at least one ring attached to said body for tethering said body to a boat; and at least one valve for inflating and deflating said body.

2. The inflatable boat transom device of claim 1, wherein said bifurcated front surface comprises:

a port side projection defined by a portion of said first side surface and a portion of said front surface;

a starboard side projection defined by a portion of said second side surface and a portion of said front surface; and said opening being at least partially defined between said port side projection and said starboard side projection.

3. The inflatable boat transom device of claim 2, wherein said opening further comprises:

a first tier; and a second tier, said first tier being above and wider than said second tier and proximal said front surface.

4. The inflatable boat transom device of claim 3, further comprising:

a plurality of rings extending from said body in said opening for tethering said body to a boat such that said opening wraps around a boat's motor and said port side projection engages a boats port side while said starboard side projection engages a boat's starboard side.

5. The inflatable boat transom device of claim 1, further comprising:

a plurality of rings extending from said body proximal said side surfaces and said rear surfaces.

6. The inflatable boat transom device of claim 1, further comprising:

a plurality of handles disposed on said body.

7. The inflatable boat transom device of claim 6, wherein said handles are proximal said side surfaces and said rear surface.

8. The inflatable boat transom device of claim 1, wherein said fibers comprise stitched polyester fibers.

9. The inflatable boat transom device of claim 1, further comprising:

at least one foam pad disposed on said upper surface.

10. The inflatable boat transom device of claim 9, wherein said foam pad comprises:

ethylene vinyl acetate (EVA).

11. The inflatable boat transom device of claim 1, further comprising:

A plurality of EVA foam pads disposed on said upper surface.

12. An inflatable boat transom device that is releasably attachable to a boat having at least one outboard motor so as to engage the boat transom and stern sides while wrapping around the boat's outboard motor(s), comprising:

a body having an upper surface, a bottom surface, a bifurcated front surface, a rear surface and first and second side surfaces separated by said front surface and said rear surface and joining said front surface to said rear surface and said upper surface to said lower surface so as to define an interior volume;

an opening formed in said bifurcated front surface and extending into said body for receiving at least one outboard motor, said opening having a first tier proximal said front surface and a second tier below said first tier, said first tier being wider than said second tier;

a plurality of fibers connecting said upper surface to said bottom surface, said fibers determining the thickness of said body when inflated;

at least one ring attached to said body for tethering said body to a boat; and at least one valve for inflating and deflating said body.

13. The inflatable boat transom device of claim 12, wherein said bifurcated front surface comprises:

a port side projection defined by a portion of said first side surface and a portion of said front surface;

a starboard side projection defined by a portion of said second side surface and a portion of said front surface; and said opening being at least partially defined between said port side projection and said starboard side projection.

14. The inflatable boat transom device of claim 12, further comprising:

at least one foam pad disposed on said upper surface.

15. The inflatable boat transom device of claim 14, wherein said foam pad comprises:

ethylene vinyl acetate (EVA).

16. The inflatable boat transom device of claim 15, further comprising:

a plurality of EVA foam pads disposed on said upper surface.

17. The inflatable boat transom device of claim 12, wherein said fibers comprise stitched polyester fibers.

18. The inflatable boat transom device of claim 12, further comprising:

a plurality of rings extending from said body in said opening for tethering said body to a boat such that said opening wraps around a boat's motor and said port side projection engages a boats port side while said starboard side projection engages a boat's starboard side.

19. The inflatable boat transom device of claim 18, comprising:

a second inflatable platform adapted for attaching to said body.

20. An inflatable boat transom device of claim 12, further comprising:

means for tethering said body to a boat comprising a strap having a clip at each end.

* * * * *